United States Patent [19]

Moranne

[11] Patent Number: 4,651,821

[45] Date of Patent: Mar. 24, 1987

[54] HEAT EXCHANGER WITH TUBES AND FINS AND TUBE-PLATES

[75] Inventor: Jean-Pierre Moranne, Saint-leu-la-Foret, France

[73] Assignee: Societe Anonyme des Usines Chausson, Asnieres, France

[21] Appl. No.: 825,949

[22] Filed: Feb. 3, 1986

Related U.S. Application Data

[63] Continuation of Ser. No. 312,844, Oct. 19, 1981, abandoned.

[30] Foreign Application Priority Data

Oct. 23, 1980 [FR] France ..... 80 22686

[51] Int. Cl.[4] ..... F28F 9/02

[52] U.S. Cl. ..... 165/175; 165/173

[58] Field of Search ..... 165/76, 173, 175, 77, 165/149, 150, 151, 152, 153; 285/137 R, 162

[56] References Cited

U.S. PATENT DOCUMENTS

| | | | |
|---|---|---|---|
| 1,228,474 | 6/1917 | Payne | 165/149 |
| 1,235,057 | 7/1917 | Roberson | 165/149 |
| 1,361,807 | 12/1920 | Bares | 165/76 |
| 3,426,841 | 2/1969 | Johnson | 165/178 |
| 3,640,552 | 2/1972 | Demler et al. | 285/110 |
| 4,191,244 | 3/1980 | Keske | 285/162 |

FOREIGN PATENT DOCUMENTS

| | | | |
|---|---|---|---|
| 2435632 | 2/1975 | Fed. Rep. of Germany | 165/149 |
| 962390 | 12/1949 | France | 165/149 |
| 2214876 | 8/1974 | France | 165/173 |
| 205278 | 10/1923 | United Kingdom | 165/76 |
| 258984 | 10/1926 | United Kingdom | 165/149 |
| 431863 | 7/1935 | United Kingdom | 165/76 |
| 1302407 | 1/1973 | United Kingdom . | |

*Primary Examiner*—Stephen F. Husar

*Attorney, Agent, or Firm*—Browdy and Neimark

[57] ABSTRACT

The heat exchanger comprises a tubular core having tubes engaged into perforations of fins inside which they are inflated. The tubes are designed for being tightly connected to tube-plates by means of deformable gaskets. The tube-plates comprise resilient interlocking elements cooperating with mating portions of the core.

15 Claims, 5 Drawing Figures

Fig. 3
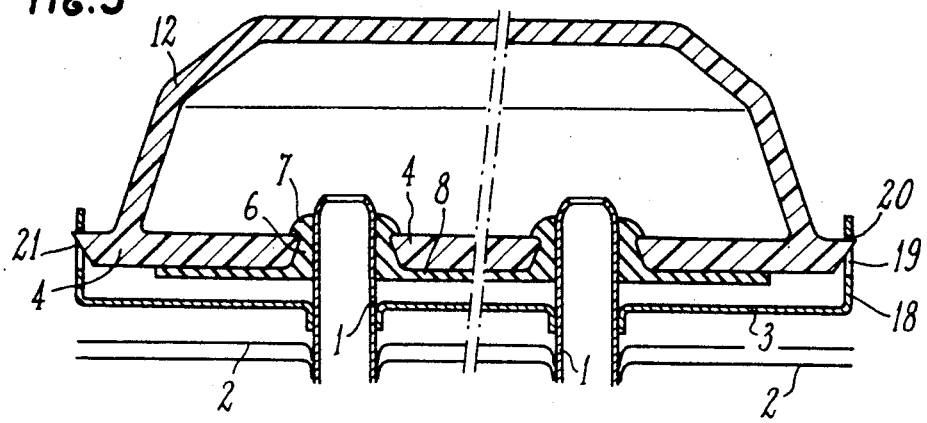
Fig. 4
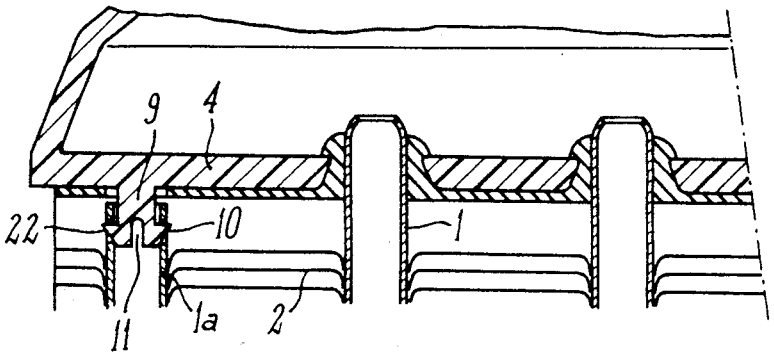
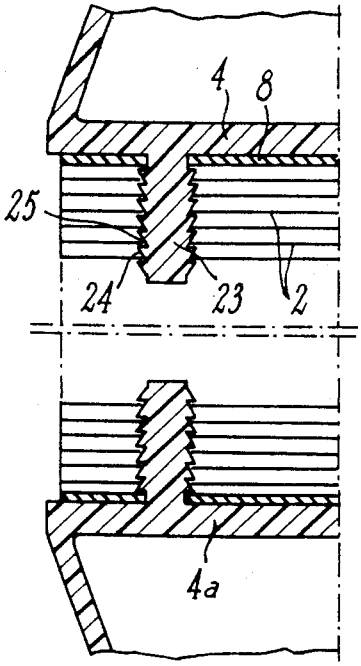
Fig. 5

HEAT EXCHANGER WITH TUBES AND FINS AND TUBE-PLATES

This application is a continuation of application Ser. No. 312,844, filed 10/19/81, now abandoned.

BACKGROUND OF THE INVENTION

The present invention relates to the manufacture of heat exchangers and to a novel and particular heat exchanger.

The manufacture of heat exchangers which are particularly usable for cooling engines conventionally uses tubes of circular section which are engaged into bundles of fins into which they are then inflated. In some known embodiments, the tube-plates ae then set in place on the ends of the tubes which protrude beyond the fins, so that subsequent inflation provides the mutual fixation of the tubes and tube-plates.

In order to insure a good tight fit, a flexible gasket is most often interposed between the outer wall of the tubes and collars formed on the tube-plates. Headers are thereafter fixed by means of tongs or clips or by crimping on the tube-plates.

The hereabovementioned embodiment gives relative satisfaction but is costly since it requires two inflating operations of the tubes, and successive manipulations since, in addition to the successive inflations of the tubes, the crimping or other fastening of the headers on the tube-plates has to be carried out subsequently.

In another known embodiment, the tubes are inflated simultaneously in tube-plates and a bundle of fins, and then tie rods are interposed between the tube-plates so that the distance between said tube-plates remains constant even after a prolonged usage, viz. after a large number of expansion and contraction cycles of tubes.

Another known embodiment involves inflating the tubes in a bundle of fins and then in forcibly inserting tube-plates provided with resilient sockets onto the protruding ends of the tubes. In this last embodiment, the tube-plate can comprise a separate insert header or may be formed by the wall of a hollow body forming both a header and a tube plate.

This last embodiment is the most simple but it can happen sometimes that the tube-plates are displaced relative to the tubes of the core since they are held simply by friction of the resilient sockets against the wall of the tube ends.

SUMMARY OF THE INVENTION

The present invention has for its object to remedy this disadvantage without making the manufacture more complex.

According to the invention, the heat exchanger is of the type comprising a tubular core with tubes engaged into perforations of fins, the tubes being designed for being tightly connected to tube-plates by means of deformable gaskets and, is characterized in that the tube-plates comprise resilient interlocking means cooperating with mating portions of the core.

Various further features of the invention will become more apparent from the following detailed description.

BRIEF DESCRIPTION OF THE DRAWINGS

Embodiments of the invention are shown by way of non limiting examples in the accompanying drawings, wherein:

FIGS. 3–5 are partial cross-sectional elevation views similar to FIG. 2 illustrating various alternative embodiments.

DETAILED DESCRIPTIONS OF THE INVENTION

Figure 1:
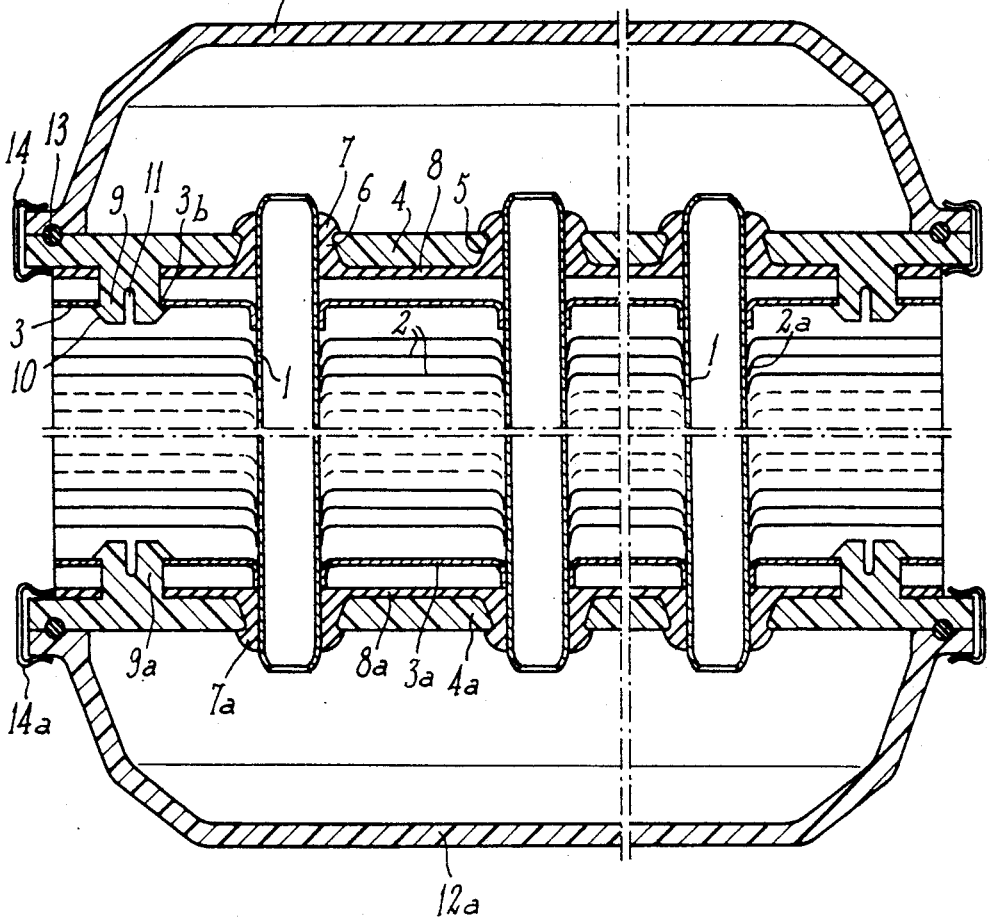
FIG. 1 is diagrammatic elevation view, partly in section, of a heat exchanger made according to the invention.

Referring now to the drawings, the heat exchanger of FIG. 1 comprises a core made of tubes 1 of a circular cross-section engaged into collars 2*a* of fins 2. Once the tubes are engaged into the fins, the tubes are inflated so that they exert a permanent pressure inside the collars, thereby providing on the one hand the mechanical connection between the tubes and the fins and enhancing on the other hand the heat conductivity between these members.

In the embodiment shown in FIG. 1, there is placed on either side of the bundle of fins 2, a form of fin 3 herein-after called "false collector" formed with collars 3*a* in which the tubes 1 are also inflated, so that the false collector 3 is fixed to the tubes in the same way as the rest of the fins.

The tube-plates, designated at 4 and 4*a*, are made of a moulded material, for example a synthetic material, and they are formed with tube passages 5 into which are placed resilient sockets 6 defining a holding flange 7 for bearing against the inner face of the tube-plate 4. It is advantageous, as shown in the drawings, that the sockets 6 are formed from a continuous plate 8 extending on the side of the tube-plate turned towards the core. The tube-plate is provided in various positions and in particular at its ends with protruding studs 9 which are resiliently deformable and comprise burrs or a holding ring 10 formed in register with openings 3*b* of the false collectors 3. In order to be resiliently deformable, the studs 9 are for example slit in their longitudinal direction as shown by notch 11.

Each tube-plate 4, 4*a* is rigidly and tightly fixed to a header 12, 12*a*. In the example shown, the headers 12, 12*a* are connected to the tube-plates 4, 4*a* via a gasket and one or several tongs or clips 14. Other modes of fixation can be used amongst those known in the art. In particular when the tube-plates and the headers are made of a synthetic material, it is possible to connect them by ultrasonic or vibration welding, or by gluing.

Figure 2:
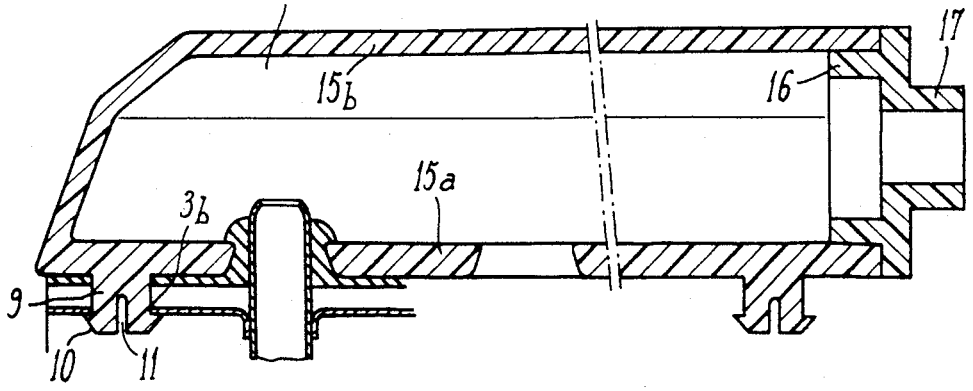
FIG. 2 is a partial cross-section of a heat exchanger, similar to that of FIG. 1, illustrating a particular feature.

FIG. 2 shows another embodiment in which each tube-plate and header sub-assembly is substituted by a hollow body 15 forming a tube-plate 15*a* and a header 15*b*. This hollow body is open at one end for its removal from the mould and said open end contains a cover 16 which can define a fitting 17 for connecting the header to a feeding pipe or, on the contrary, to a discharge pipe of the circulation fluid.

In the following disclosure, when the description refers to a tube-plate and header, either of the embodiments described with reference to FIG. 1 or to FIG. 2 are to be considered indifferently.

In order to make the heat exchanger, as described hereabove, one proceeds as follows:

The tubes 1 are engaged into a bundle of fins 2 and into the false collectors 3 placed on either side of the fin bundle. The tubes 1 are then inflated and thereby rigidly connected to the fins and to the false collectors. On the other hand, the sub-assemblies formed by the tube-plates 4, 4*a* and their headers 12, 12*a* or by the hollow bodies 15 are prepared. The tube-plates 4, 4*a* or the parts 15*a* which are used instead are then provided with the sockets 6 with collars 7, and these sub-assemblies are inserted onto the protruding ends of the tubes 1 until the studs 9 are interlocked into the openings 3*b* provided to this effect in the tube-plates.

When referring to the embodiment of FIG. 1, one would not depart from the scope of the invention by first putting in position the tube-plates 4, 4*a* so that the studs 9 are interlocked into the openings 3*b*, and then assembling on said tube-plates 4, 4*a* the headers 12, 12*a*.

FIG. 3 illustrates an alternative embodiment according to which the false collectors 3 are formed on two at least of their sides with upright edges 18 comprising openings 19 mating with protruding edges 20 formed by each tube-plate 4, 4*a*, said protruding edges 20 being oblique in order to define ramps 21 the most narrow portion of which is standing back relative to the inner wall of the upright edges 18. The other portions of the heat exchanger are similar to those described hereabove.

When the tube-plate-header subassemblies are prepared with the sockets 6 in position, these subassemblies are forcibly driven onto the ends of the tubes 1 until the protruding edges 20 are interlocked into the openings 19.

FIG. 4 shows another alternative embodiment according to which a number of tubes 1*a* of the core are shorter than the tubes 1 and are placed in the fins 2 opposite the studs 9 protruding from the tube-plates 4. The tubes 1*a* are formed in their walls with latching openings 22 into which are interlocked the burrs 10 of the deformable studs 9. This embodiment permits the false collectors 3 described hereabove to be omitted, the tubes 1*a* forming moreover tie rods between the two heat exchanger tube-plates. The tubes 1*a* have perferably in cross-section the same diameter as the tubes 1, but they can have, without departing from the scope of the invention, a different diameter and even, possibly, a cross-section which is not a circular shape.

FIG. 5 illustrates still another alternative embodiment according which the tube-plates 4, 4*a* comprise, on their side turned towards the fins 2, studs 23 formed on a portion at least of their lateral surface with teeth 24.

Openings 25 having a shape mating with that of the studs 23 are cut out in the fins 2, these openings not comprising collars. The shape in cross-section of the studs 23 as well as that of the openings 25 can be as desired, for example circular, but they can also be polygonal if it is desired that the tube-plate-header subassemblies can be put in place only in a single position relative to the core, viz. that the openings and studs serve then as means to prevent positioning errors, such a feature being provided either by the shape or by the disposition of the studs. It is also advantageous that the shape of the teeth is chosen such that the introduction is carried-out without great effort, viz. that the anterior face of the teeth is inclined, while the extraction is made difficult, and even impossible, by virtue of the fact that the rear face of the teeth is plane or reversed relative to the inclination of the anterior face.

The arrangement described hereabove with reference to FIG. 5 also facilitates the use of a core which does not include false collectors and in which the studs with their teeth 24 can be used as bracing elements for the fins if said studs are designed for being engaged over a substantial height, even up to half of the height of the core.

The invention is not limited to the embodiments shown and described in detail and various modifications can be carried out without departing from the scope of the invention. For example, the fixation means of the heat exchanger to a frame or chassis, for example the body of a vehicle, can be indifferently provided on the headers 12, 12*a*, the tube-plates 4, 4*a* or on side flanges attached either to the fins, the tube-plates or the headers, or even to the false collectors when such false collectors are provided.

What is claimed is:

1. A heat exchanger, comprising:

substantially parallel fins each with an array of openings, said fins being disposed in a stack having first and second opposing surfaces, a fin-like false collector element disposed parallel to, and in overlying relationship with, each of said first and second surfaces of said stack, each false collector element including openings disposed in said array, a tube end plate disposed parallel to, and in overlying relationship with, each of said collector elements, each tube end plate including openings disposed in said array, each tube end plate further including deformable gasket means disposed in said openings, and tubes disposed normal to, and having end portions extending through, said stack of fins, said false collector elements and said tube end plates, each of said tubes being engaged with said gasket means in said respective openings in said tube end plates, whereby said tubes, said tube end plates, said false collector elements and said fins are firmly secured together as a single core element, said tube end plates and said false collector elements each further including cooperating interlocking means, disposed within said single core element, for securing each false collector element with the adjacent tube end plate.

2. The heat exchanger of claim 1, wherein said interlocking means of each of said false collector elements comprise a plurality of apertures, and said interlocking means of each of said tube end plates comprise studs, projecting toward the adjacent false collector element, for engagement within a respective one of said apertures in each of said false collector elements.

3. The heat exchanger of claim 2, wherein each of said studs has a cross-wise dimension no greater than the cross-wise dimension of said apertures and includes a deformable end portion having a cross-wise dimension greater than the cross-wise dimension of said apertures, said deformable end portion extending through a respective one of said apertures in each of said false collector elements.

4. The heat exchanger of claim 3, wherein each of said deformable end portions include a surface, of said greater cross-wise dimension, for engaging the side of said false collector opposite said adjacent tube end plate after said deformable end portion has been inserted through said respective aperture.

5. The heat exchanger of claim 4, wherein each of said studs has a longitudinal axis, and said deformable end portion of each of said studs includes a longitudinal slit, whereby the cross-wise dimension of said deformable end portion, upon insertion into a respective aperture, is reduced to the cross-wise dimension of said aperture so that said end portion can pass through said aperture and said surface can engage said side of said false collector opposite said adjacent tube end plate.

6. The heat exchanger of claim 5, wherein said deformable end portion of each of said studs comprise an annular holding ring.

7. The heat exchanger of claim 5, wherein said deformable end portion of each of said studs comprise burrs extending substantially normal to said longitudinal axis.

8. The heat exchanger of claim 2, wherein said gasket means in said respective openings in said tube end plates comprise resilient sockets in which are engaged said tubes and means for unitarily interconnecting said resilient sockets to form a single element, said means for unitarily interconnecting said resilient sockets being disposed adjacent said tube end plate on the side thereof from which said studs project, said studs projecting away from said tube end plate and extending through said interconnecting means.

9. The heat exchanger of claim 8, wherein each of said studs has a cross-wise dimension no greater than the cross-wise dimension of said apertures and includes a deformable end portion having a cross-wise dimension greater than the cross-wise dimension of said apertures, said deformable end portion extending through a respective one of said apertures in each of said false collector elements.

10. The heat exchanger of claim 9, wherein each of said deformable end portions include a surface, of said greater cross-wise dimension, for engaging the side of said false collector opposite said adjacent tube end plate after said deformable end portion has been inserted through said respective aperture.

11. The heat exchanger of claim 10, wherein each of said studs has a longitudinal axis, and said deformable end portion of each of said studs includes a longitudinal slit, whereby the cross-wise dimension of said deformable end portion, upon insertion into a respective aperture, is reduced to the cross-wise dimension of said aperture so that said end portion can pass through said aperture and said surface can engage said side of said false collector opposite said adjacent tube end plate.

12. The heat exchanger of claim 11, wherein said deformable end portion of each of said studs comprise an annular holding ring.

13. The heat exchanger of claim 11, wherein said deformable end portion of each of said studs comprise burrs extending substantially normal to said longitudinal axis.

14. The heat exchanger of claim 1, wherein each said tube end plate and its adjacent false collector are separated from one another by a space, and said interlocking means of said tube end plate extends from said tube end plate, across said space and into engagement with said adjacent false collector.

15. The heat exchanger of claim 14, wherein said interlocking means of said false collector comprises a plurality of apertures, said interlocking means of said tube end plate comprises a corresponding number of studs, each of said studs having a shank terminating in a deformable end portion, said deformable end portion being engaged with a respective one of said apertures, and said shank spanning said space.

* * * * *